United States Patent [19]

Krall et al.

[11] Patent Number: 4,845,508

[45] Date of Patent: Jul. 4, 1989

[54] ELECTRIC WAVE DEVICE AND METHOD FOR EFFICIENT EXCITATION OF A DIELECTRIC ROD

[75] Inventors: Albert D. Krall, Rockville; James P. Coughlin, Catonsville, both of Md.

[73] Assignee: The United States of America as represented by the Secretary of the Navy, Washington, D.C.

[21] Appl. No.: 859,109

[22] Filed: May 1, 1986

[51] Int. Cl.[4] ..... H01Q 13/02

[52] U.S. Cl. ..... 343/785; 343/786

[58] Field of Search ..... 343/784, 785, 786

[56] References Cited

U.S. PATENT DOCUMENTS

| | | | |
|---|---|---|---|
| 2,599,896 | 6/1952 | Clark | 250/323.63 |
| 3,154,784 | 10/1964 | Allen | 343/18 |
| 3,268,902 | 8/1966 | Turrin | 343/785 |
| 3,605,101 | 9/1971 | Kolettis et al. | 343/783 |
| 3,935,577 | 1/1976 | Hansen | 343/781 |
| 4,274,097 | 6/1981 | Krell et al. | 343/785 |
| 4,280,223 | 7/1981 | Roettel et al. | 375/93 |
| 4,447,811 | 5/1984 | Hamid | 343/783 |
| 4,468,672 | 8/1984 | Dragone | 343/785 |

OTHER PUBLICATIONS

"Corrugated Horns for Microwave Antennas", P. J. B. Clarricoats, A. D. Olver Peregrinos Ltd London '84.

Field Theory of Guided Waves, R. E. Collins, McGraw Hill, 1960.

Antenna Engineering Handbook, 2nd Ed., Johnson et al editors, pp. 12–21.

1. –"Dielectric Rod Antenna Materials" by Krall & Coughlin, IEEE 5th Annual Franklin symposium of May 4, 1985.

2. –"Radiation Mechanism of Dielectric Rod and Yagi Aerials" Electronic Letters, Aug. 6, 1970, vol. 6, #16, pp. 528–530.

*Primary Examiner*—William L. Sikes

*Assistant Examiner*—Doris J. Johnson

*Attorney, Agent, or Firm*—Kenneth E. Walden; Frederick A. Wein

[57] ABSTRACT

An electric wave operating device for efficiently coupling electromagnetic energy from a waveguide into a dielectric element or vice versa. A waveguide horn portion is chosen for radiating in the primary $HE_{11}$ mode and designed to have a predetermined $HE_{11}$ mode farfield radiation pattern. A dielectric member is securely disposed with one end in the plane of the aperture of the waveguide horn with the dielectric member having a predetermined $HE_{11}$ mode farfield radiation pattern substantially equal to the farfield radiation pattern of the horn.

12 Claims, 2 Drawing Sheets

ELECTRIC WAVE DEVICE AND METHOD FOR EFFICIENT EXCITATION OF A DIELECTRIC ROD

BACKGROUND OF THE INVENTION

A dielectric rod antenna has been well known in the art since the 1930's but there is little available information that enables one to decide which dimensions or dielectric material to choose in designing such an antenna. The dielectric material chosen has to have low loss and have suitable physical characterisitics as well as being relatively low in cost. However, the choice between a high dielectric constant material and one of a low dielectric constant material has heretofore been left unanswered.

It is well known that electromagnetic fields or modes can exist in a dielectric cylinder. Most useful among the modes and the one which is the subject matter of the present invention is the dominant or $HE_{11}$ mode. This mode can exist alone bound to a uniform cylindrical dielectric rod provided the rod diameter (D), and the wavelength ($\lambda$) satisfies the inequality $D/\lambda \leqq$ to $0.766/(Er-1)^{\frac{1}{2}}$ where (Er) is the relative dielectric constant of the rod with respect to its surroundings. If the rod remains uniform as in the case of a fiber optic cable, no radiation will occur. However, at the end of a finite rod, the fields of the $HE_{11}$ mode can be treated as though they extend over an aperture. From this aperture, the farfield radiation pattern can be calculated as presented by Brown and Spector, "The Radiating Properties of End-Fire Aerials", proceedings IEE, Volume 104B, January 1957.

A common method in the prior art of exciting a dielectric rod is shown in FIG. 1 which is taken from the Antenna Engineering Handbook, H. Jasik, Editor McGraw-Hill New York 1961, and will be discussed more completely hereinafter. Typically, a rectangular or circular wave guide is enlarged into a rectangular or circular launching horn. The cylindrical dielectric rod, usually tapered at the inserted end for over a few wavelengths, is inserted into the horn as shown in FIG. 1. Typically, the insertion of the dielectric rod into the horn is as a secured wedge with the dielectric rod making interference contact with the adjacent portions of the waveguide horn. The problem with this construction is that the electromagnetic field configurations of the waveguide or horn are not the same as the field configurations needed to efficiently excite the dielectric rod. As a result, only part of the energy available from the waveguide is transferred to the dielectric rod. The rest of the energy is usually radiated in an uncontrolled manner, e.g. enlarged side lobes, over a wide angle of space. If the rod is being used as a transmission line, the radiation represents a loss of energy. If the rod is being used as an antenna, the loss of energy is even worse. The uncontrolled radiation adds in the farfield with the intended radiation of the antenna and produces a result that is for the most part undesirable, such as an increase in the beam width from the antenna. Similarly situations arise from other forms of excitation with modes between the transmission waveguide and the dielectric rod not matching, both in energy distribution and spatial distribution.

Accordingly, it is desirable to provide a method and apparatus for the efficient excitation of a dielectric rod wherein the energy transferred from the waveguide to the dielectric rod is maximized and wherein the farfield radiation pattern of the antenna is not encumbered with beam broadening or wasteful side lobes.

SUMMARY OF THE INVENTION

Briefly, the present invention relates to an electric wave operating device for efficiently coupling electromagnetic energy from a waveguide into a dielectric element or vice versa. A waveguide horn portion is chosen for radiating in the primary $HE_{11}$ mode and designed to have a predetermined $HE_{11}$ mode farfield radiation pattern. A dielectric member is securely disposed with one end in the plane of the aperture of the waveguide horn with the dielectric member having a predetermined $HE_{11}$ mode farfield radiation pattern substantially equal to the farfield radiation pattern of the horn. The dimensions of the horn aperture and the end of the dielectric member disposed in the plane of the aperture are determined to achieve the general equivalence of the respective farfield radiation patterns of the horn and the dielectric rod.

Accordingly, it is an object of the present invention to provide a means and apparatus for efficiently coupling electromagnetic energy from a waveguide to a dielectric element.

Another object of the present invention is to provide a method and device for coupling electromagnetic energy from waveguide to a dielectric element by positioning one end of the dielectric element in the plane of the aperture of the waveguide with the dimensions of the aperture and the waveguide at the aperture being determined to substantially equate the respective farfield radiation patterns of the waveguide and the dielectric member.

Further objects and advantages of the present invention will become apparent as the following description proceeds and features of novelty characterizing the invention will be pointed out with particularity in the claims annexed to and forming a part of this specification.

DESCRIPTION OF THE DRAWINGS

For a better understanding of the present invention reference may be had to the accompanying drawings wherein.

DETAILED DESCRIPTION OF THE PREFERRED EMBODIMENT

The present invention relates to $HE_{11}$ mode radiation devices, and more particularly to a dielectric rod antenna wherein the rod is efficiently excited by the microwave horn.

One of the most common ways to excite the hybrid mode in a rod is to taper the rod and to insert the tapered end of the rod into a conical or rectangular horn such that the rod is tightly wedged within the throat of the horn.

Figure 1:
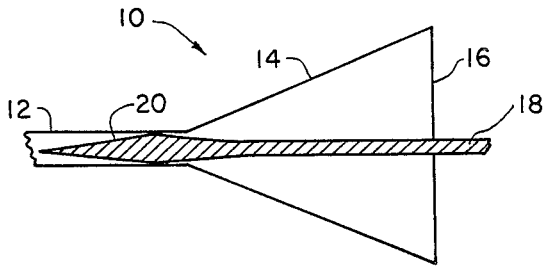
PRIOR ART FIG. 1
FIG. 1 shows the prior art in cross-section wherein a tapered dielectric rod is wedged into the throat of a waveguide horn.

Referring now to the drawings wherein like reference numerals have been applied to like members there is shown in FIG. 1 a representative of a prior art dielectric rod antenna generally designated 10. Antenna 10 comprises a throat portion 12 and a horn 14 having an opening aperture 16 where radiation of appropriate electromagnetic energy, usually microwave energy is accomplished. A dielectric rod 18 is inserted in through the opening 16 which can be circular or rectangular and is securely wedged within the throat 12. The inserted end of rod 18 is tapered 20 in order to reduce the abruptness of the interface between the rod 18 and the feed energy from the horn throat 12. The diagram of FIG. 1 is taken from Antenna Engineering Handbook, H. Jasik, Editor, McGraw-Hill, 1961.

For the electromagnetic antenna of FIG. 1, the configurations of the waveguide or horns do not have the same field configuration as needed by the dielectric rod as is stated hereinbefore. In the present invention, the dielectric rod and the horn have been combined to produce a one-to-one match of electric field configurations from the exciter to the excited. The action is reciprocal and as such the excitation action will occur no matter which direction the signal travels.

The horn can be fed from a common transmission line and providing that appropriate known transducers are utilized, the horn can be fed with nearly 100% efficiency. Additionally, the horn can be designed to present the $HE_{11}$ mode field configuration at its aperture which in the exemplary embodiment is a circular corrugated horn. All of this occurs internal to the metallic walls of the horn which prevents spurious radiation into space. At the aperture of the horn, a dielectric rod can be introduced so that the rods permitted electric fields, the dominant $HE_{11}$ mode in this case, align with the horn's existing fields. For such a case, the transfer of energy then occurs on a one-to-one match of electromagnetic modes and thus avoids any unwanted radiation in the process.

A proper size horn that matches a given size dielectric rod of a particular dielectric constant must then be determined in order to provide this one-to-one match. The method and apparatus disclosed herein assumes that if the farfield radiation patterns of any two antennas are equal then their nearfield radiation patterns at their respective apertures must also be equal.

Figure 3:
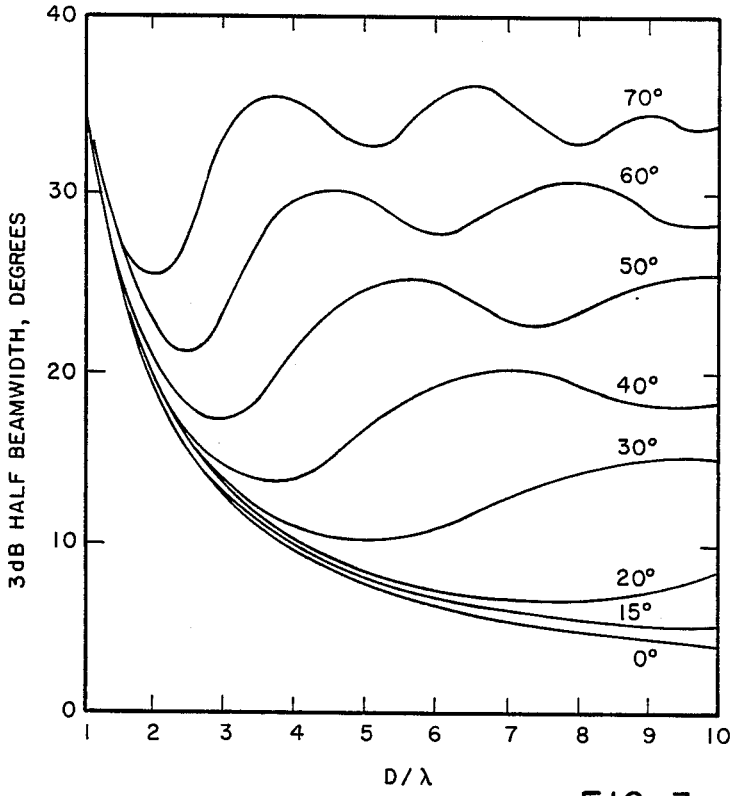
FIG. 3 shows a graph for calculating the diameter of the aperture of the horn of FIG. 2.

The graph of FIG. 3 is taken from "Corrugated Horns for Microwave Antennas" by P. J. B. Clarricoats & A. D. Olver, Peregrinus Ltd., London, UK, 1984 permits the determination of the normalized horn diameter $D/\lambda$ for any halfpower half-beamwidth (HPBW/2) at any horn flare angle. This graph permits a determination of horn diameter for a farfield excitation pattern.

Figure 4:
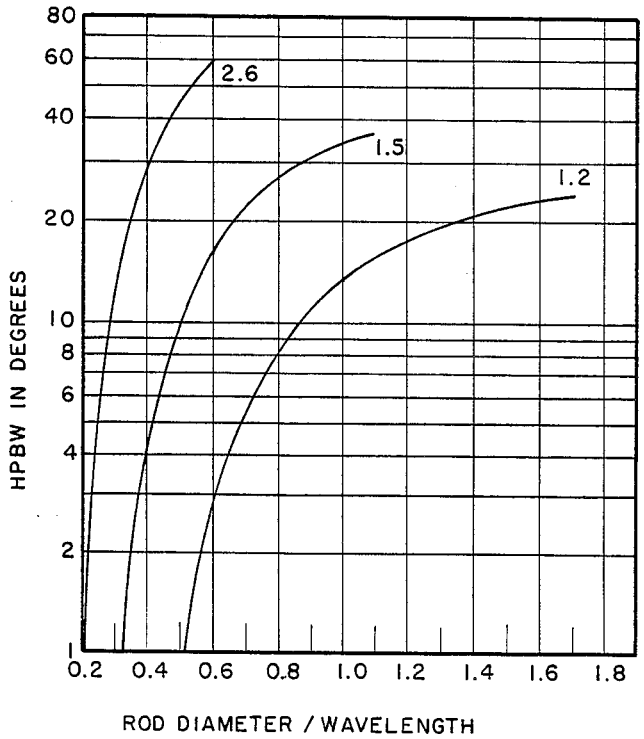
FIG. 4 shows a graph for determining the diameter of the dielectric material disposed in the plane of the aperture of the horn of FIG. 2 such that the farfield radiation pattern of the dielectric material is substantially the same as the farfield radiation pattern of the horn.

The problem now turned to is to make a similar determination of the diameter of the dielectric rod. As is well known in the art, the eigenvalue equations for the $HE_{11}$ mode on a dielectric rod have been derived by Hondos and Debye in 1910 to give a plot as a function of $\lambda$. Neumann, "Radiation Mechanism of Dielectric Rod and Yagi Aerials", Electrical Letters, 6 August 1970, shows equations for $\lambda$ as a function farfield of beamwidth thus translating from $\lambda$ wavelength to beamwidth. The equations of Neumann are then combined with the eigen solution of the $HE_{11}$ from Maxwell's equations as shown in FIG. 3 and thus allows a similar determination of diameter for the dielectric rod. The most surprising result from FIG. 4 is that the HPBW is a function of the rod diameter, the wavelength, and the dielectric constant but not of the internal length as other theories and much experimental data seemed to indicate. The farfield HPBW of any diameter and dielectric constant can be found from FIG. 4.

Thus, by choosing a farfield beamwidth of the dielectric rod equal to the farfield beamwidth of a corrugated horn, the horn diameter for a particular horn flare angle can be found that will have the identical spatial nearfields as does the corresponding rod diameter when its relative dielectric constant has been selected. At the corrugated horn apertures so determined, the dielectric rod is then inserted into the aperture and can be held in position in the plane of the aperture of the horn by a nonconductor whose dielectric constant is near that of air as will be discussed in more detail hereinafter. A low density polystyrene foam is used in the exemplary embodiment.

To minimize the abrupt discontinuity of the dielectric rod at the horn aperture, the rod can be tapered for a few wavelengths into the horn as depicted in FIG. 4. The taper is usually greater than the inverse to the internal taper of the horn flare. The choice of a low dielectric material for the rod will greatly aid in reducing the discontinuity. Rod materials with relative dielectric constants as low as 1.2 have been successfully used and it is expected that materials as low as 1.05 would be successful. There does not seem to be upper limit on high values of dielectric constants that are usable if reflections from them are tolerable.

Figure 2:
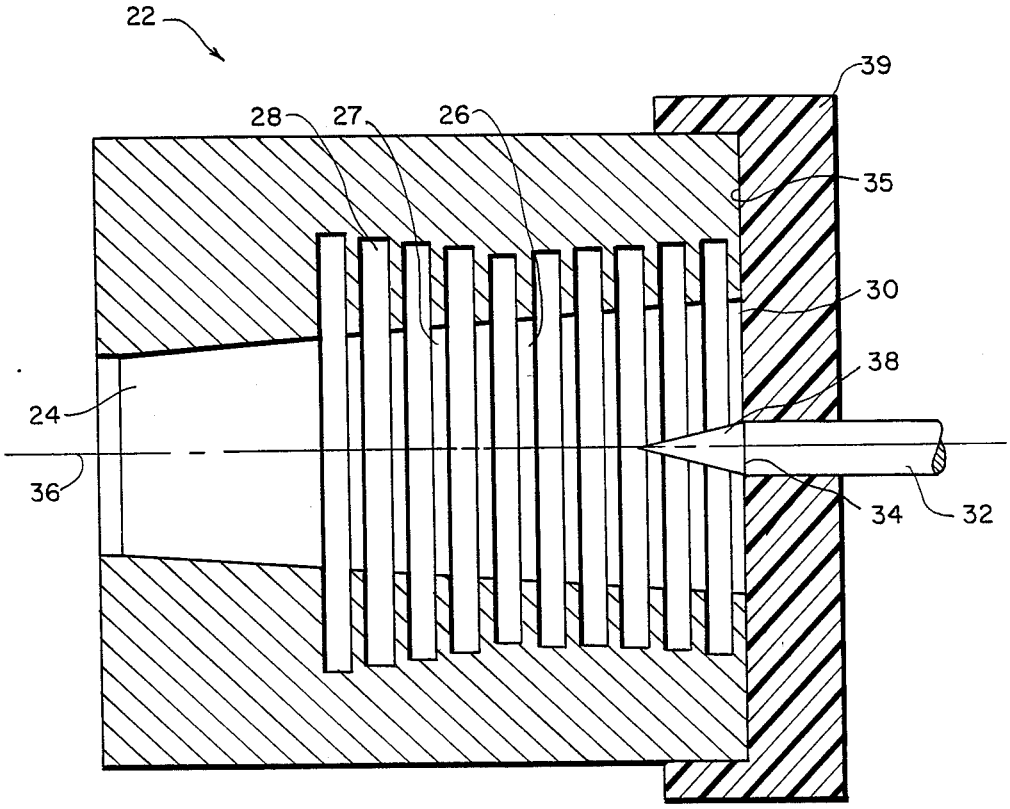
FIG. 2 shows a horn in accorded with the present invention wherein an end of a dielectric rod is disposed in the plane of the aperture of a waveguide horn radiating in the $HE_{11}$ mode with a tapered portion extending inwardly into the cavity of the horn, the horn being shown in cross-section.

Referring now to FIG. 2, there is shown a corrugated horn generally designated 22 having a throat 24 and a flare area 26 and cavity 27 with corrugations 28 and an aperture 30. The dielectric rod 32 is disposed with the end of the maximum diameter portion 34 lying in the plane 35 of the aperture 30 along an imaginary longitudinal axis 36. The dielectric rod 32 is held in place, in the exemplary embodiment, with respect to horn 22 and aperture 30 by a block of polystyrene foam 39. In order to avoid spurious radiation, rod 32 is tapered inwardly from aperture 30 towards axis 36 at 38 for a few wavelengths to minimize this abrupt discontinuity. As described in Clarricoats, supra , a conical corrugated horn can be constructed so that it excites the $HE_{11}$ mode in its aperture. This excitation can be used to excite the mode directly in the rod. Choosing the lowest dielectric constant possible produces the least disturbance in the horn and allows for a more perfect transition to the rod. It is also desirable to have the smallest possible excitation horn since a large horn precludes the need for a dielectric rod. The smallest usable horn corresponds to the largest usable rod diameter. This is because the larger rod diameters bind the external mode fields more closely to the rod and thus a perfect field match will require a smaller horn. The largest rod diameters without exciting higher order modes are given by the aforementioned inequality, these diameters are also plotted as the right hand end points of the curves of FIG. 4. The horn that will match the excitation of any particular rod will also have a farfield HPBW identical to that rod. Since both devices produce Gaussian farfield patterns, the Fourier transforms of these will have identically matched Gaussian nearfield patterns.

As to the question of rod length, a corrugated horn with a specific HPBW that matches a given dielectric rod whose D/λ also produces the same HPBW is used. This is done to avoid radiation at the transition period. The desired HPBW for the dielectric rod is generally much smaller, except if the combination is being used solely to fix a focal plane. As shown in FIG. 4, the desired HPBW will intercept the chosen dielectric curve and determine the required terminating diameter of the rod. It is then necessary to go from the excitation diameter to the terminated diameter. Up to this point, the rod has been considered uniform and now tapering must be addressed if the rod is to be utilized as a radiating antenna. Unfortunately, other modes that radiate broadband patterns can be excited along tapers. Theory indicates that the tapered radiation can be minimized by making the internal length longer by using an exponential taper, and/or by using the lowest dielectric constant possible.

Experimental evidence indicate that tapering decreases the beamwidth and exponential tapers produce lower side lobes than do linear tapers. Increasing the length of the antenna also decreases the sidelobes and does not necessarily decrease the beamwidth. Decreasing the dielectric constant produces its expected effect.

Balsa wood rods which have the lowest dielectric constant (Er=1.2) tried, have produced the narrowest beamwidths (10 degrees). Sidelobes are observed below −20 dB with gains greater than 20 dBi, at X-band frequencies. It is anticipated but not verified that there is an increase in beamwidth (defined by a usable beamwidth) as the dielectric constant is lowered. From FIG. 4, this is to be expected because of the decrease in slope with lower dielectrics. However, the overriding effects of the excitation horn have so far masked this direct observation. It is also speculated that there is a decrease in beamwidth as the frequency is decreased as can be seen from FIG. 4 which is the opposite of what is expected from an aperture defining a fixed boundary such as a horn.

EXAMPLE

Suppose it is desired to excited a rod of polystyrene, the nominal dielectric constant being 2.6. Suppose further it is desired that one use the smallest possible aperture of (for example) a corrugated horn. It is well known that the smallest horn aperture produces the largest farfield beamwidth. Since the method of matching horn to rod disclosed herein relies on first matching the farfield beamwidths, we now refer to FIG. 4. In FIG. 4 which pertains to the dielectric rod, the largest half-power beamwidth (HPBW) on the curve corresponding to 2.6 yields 60° when the rod diameter D=0.605 times the wavelength of operation. The reason the curve terminates at 60° is that it is possible to excite other modes whose field patterns are not accounted for in this disclosure beyond the 60° point. Thus a polystyrene rod (Er~2.6) of diameter (D=0.605λ) is to be excited by a corrugated horn aperture whose farfield beamwidth is also 60°.

Referring now to FIG. 3, which concerns the corrugated horn, the ordinate is one-half the HPBW which means we are looking for an aperture that produces a farfield corresponding to 30°. Since the curves of the semi flare angles of the horn converge in this region it can be seen that almost any taper will produce the same results. At the corresponding absiccsa, an aperture of diameter D=1.3 λ will produce a farfield HPBW of 60°. It will also produce the nearfield $HE_{11}$ mode spatial pattern to match the $HE_{11}$ mode spatial pattern for exciting a polystyrene rod of diameter D=0.605 λ.

The above disclosed device is also applicable to electromagnetic waves in general and to microwaves of appropriate frequency including the microwave region commonly referred to as the far infrared. The dielectric rod in the case of the infrared spectrum would be a fiber optic rod and would permit the optimum coupling to such fiber optic waveguide for light transmission at significant distances.

Thus, there is disclosed an electromagnetic wave operating device for use in the microwave or infra-red spectrum region for coupling electromagnetic energy from a waveguide to a dielectric element which can be a fiber optic waveguide. The waveguide portion has an aperture for radiating electromagnetic energy in the $HE_{11}$ mode and has a predetermined farfield radiation pattern. The dielectric rod is securely placed at the plane of the aperture with a diameter predetermined by the $HE_{11}$ mode farfield radiation for the rod which is chosen to be substantially equal to the farfield radiation pattern of the horn. The dielectric rod can be tapered inwardly in the horn aperture to minimize reflected radiation.

While there has been illustrated and described what is at present considered to be a preferred embodiment of the present invention, it will be appreciated that numerous changes and modifications are likely to occur to those skilled in the art and it is intended in the appended claims to cover all those changes and modifications which fall within the true spirit and scope of the present invention.

What is claimed as new and desired to be secured by Letters Patent is:

1. An electric wave operating device for coupling electromagnetic energy between a waveguide and a dielectric element comprising:

a waveguide horn portion having a diverging tapered horn cavity and a planar aperture disposed about an imaginary centrally disposed longitudinal axis, the horn aperture having a predetermined $HE_{11}$ mode farfield radiation pattern, and an elongated dielectric rod portion disposed along the central axis and having a first end securely disposed along the axis in the plane of the horn aperture with the remainder of the rod being disposed outwardly of the horn aperture along the central axis, the rod portion having a predetermined $HE_{11}$ mode farfield radiation pattern substantially equal to the farfield radiation pattern of the horn portion.

2. The device of claim 1 wherein the predetermined diameters of the horn aperture and the first end of the dielectric rod are determined by the equivalence of the respective farfield patterns.

3. The device of claim 2 wherein the centrally located axial first end of the rod portion is tapered inwardly of the horn aperture towards the central axis.

4. The device of claim 3 wherein the dielectric rod portion is made of balsa wood.

5. The device of claim 2 wherein the electromagnetic energy is microwave energy and the device is a microwave antenna.

6. The device of claim 2 wherein the dielectric rod is an optical fiber.

7. The device of claim 1 wherein the aperture has a circular cross-section, the rod has a circular cross-section, and the perimeter of the first end is spaced a predetermined equicircumpositional distance from the circumferential inner surface of the wall of the horn at the aperture.

8. An electric wave operating device for coupling electromagnetic energy between a waveguide and a dielectric element comprising:

A waveguide horn portion having an aperture for radiating $HE_{11}$ mode electromagnetic energy and having a predetermined $HE_{11}$ mode farfield radiation pattern, and a dielectric member with one end securely disposed at the aperture, the dielectric member having a predetermined $HE_{11}$ mode farfield radiation pattern substantially equal to the farfield radiation pattern of the horn, the diameters of the horn aperture and the end of the dielectric member being determined by the general equivalence of the respective farfield radiation patterns.

9. The device of claim 8 wherein the dielectric member end is tapered inwardly of the horn cavity.

10. The device of claim 8 wherein the dielectric member is an optical fiber.

11. The device of claim 9 wherein the horn aperture and the end of the dielectric member are coaxially disposed.

12. A method of excitation of a dielectric rod comprising the steps of (a) providing a waveguide horn having an aperture for radiating $HE_{11}$ mode electromagnetic energy and having a predetermined $HE_{11}$ mode farfield radiation pattern as determined by the diameter of the aperture, (b) providing in interchangeable order with step (a) a dielectric member having a predetermined $HE_{11}$ mode farfield radiation pattern substantially equal to the farfield radiation pattern of the horn of step (a) as determined by the diameter of the dielectric member at the aperture, (c) securing the end of the dielectric member in the aperture of the horn with a dielectric material, and (d) electrically exciting the horn with electromagnetic energy.

* * * * *